United States Patent [19]

Pearson et al.

[11] Patent Number: 4,518,296

[45] Date of Patent: May 21, 1985

[54] APPARATUS FOR BINDING SHEETS TOGETHER

[75] Inventors: Walter C. Pearson, St. Paul; Dorman N. Thompson, Jr., St. Croix Beach, both of Minn.

[73] Assignee: Minnesota Mining and Manufacturing Company, St. Paul, Minn.

[21] Appl. No.: 533,507

[22] Filed: Sep. 19, 1983

[51] Int. Cl.[3] ..... B42C 9/00

[52] U.S. Cl. ..... 412/37; 281/21 R; 412/8; 412/36

[58] Field of Search ..... 281/21 R; 412/8, 10, 412/37, 6, 33, 36

[56] References Cited

U.S. PATENT DOCUMENTS

| | | | |
|---|---|---|---|
| 848,680 | 4/1907 | Nelson | 281/21 R |
| 1,765,194 | 6/1930 | Von Auw | 281/21 R |
| 2,185,721 | 1/1940 | Brisendine | 412/8 X |
| 2,455,971 | 12/1948 | Bosch | 412/8 |
| 4,373,843 | 2/1983 | Lang | 412/10 |

*Primary Examiner*—Paul A. Bell

*Attorney, Agent, or Firm*—Donald M. Sell; James A. Smith; John C. Barnes

[57] ABSTRACT

A binding machine for binding a stack of sheets together by the use of a strip of tape has a slot for receiving and aligning sheets, the sheets are then clamped along one edge and a flexible sheet is used to roll and hold said sheets in an arc over the clamping means to offset said edges evenly and hold the same on a platen for positioning a length of pressure-sensitive tape along said edges for binding said sheets together.

7 Claims, 7 Drawing Figures

APPARATUS FOR BINDING SHEETS TOGETHER

BACKGROUND OF THE INVENTION

1. Field of the Invention

This invention relates to a binding machine for use in binding edges of sheets together to form a booklet or pamphlet, and more particularly, to a manually operated apparatus for assembling sheets to be bound by a strip of pressure-sensitive adhesive tape.

2. Description of the Prior Art

The prior art provides many systems for binding sheets together and for binding sheets into signatures and binding the signatures together, but the prior art also provides a teaching of shingling one edge of a stack of sheets such that the sheets may be bound together by a sheet of cloth or other binder utilizing a glue or other suitable cementing material, a thickness of cheese cloth being inserted between the binder proper and the glue with the result that the extreme end of each sheet and a short section of the sheet adjacent the underside will be adhered to the binder. Such a construction is illustrated in U.S. Pat. No. 848,680, issued Apr. 2, 1907.

U.S. Pat. No. 1,765,194 illustrates a manner of fastening sheets together utilizing a pair of blocks between which a stack of sheets are clamped and then the stack may be flexed about a rounded edge of one of the blocks to fan the ends of the sheets into a stepped relation. The ends of the sheets are then bound together by a thin or frail material such as Japanese tissue upon which a gum or other adhesive is spread to bind the paper to the ends of the sheets in the fanned position.

Thus, the prior art provides the teaching of fanning of sheets and applying an adhesive material to the ends to bind the sheets together. When the patents referred to above issued no tapes were available having a pressure-sensitive adhesive of the type which would be desired to use in such a binding process for ease in binding, but, to anyone skilled in the art today a teaching exists therein to fan the sheets and apply to them a strip of material having a suitable gum, glue, or even a pressure-sensitive adhesive. The difficulty however is in developing a tape which is pliant to contact the adhesive to each sheet and in providing a novel device which may be utilized with various numbers of sheets to permit one to readily bind the same into a booklet or pamphlet in a manner which will provide a neat appearing document for purposes of presentation of the material or to merely file or store the material such that it may be retained together simply and easily. That is not taught by the prior art.

The device of the present invention provides a device which is very simple to use and will readily offset the edges of the sheets evenly and sufficiently that one can bind the sheets together and form a neat appearing book. The binding apparatus of the present invention does not utilize any separable parts which are assembled or disassembled to properly offset or shingle the sheets for binding.

SUMMARY OF THE INVENTION

The apparatus of the present invention provides a binding machine or apparatus comprising means for performing the steps of receiving a plurality of sheets to align the same edgewise, clamping means for clamping the sheets in position; means for bringing and holding the sheets in an arc greater than 180 degrees to place the aligned edges of the sheets over the opposite edges to a position for binding with the edges of adjacent sheets offset edgewise at least three times the thickness of the sheets, and platen means for supporting the offset edges of the sheets such that a strip of tape may be applied across said edges to join the exposed offset edges of each of the sheets together. The binding apparatus of the present invention utilizes only manual dexterity to properly position a stack of sheets for binding, for locking the stack together, for bringing one end of the sheets about an arc and over the edge of the sheets when in the locked position to offset the free edges of the sheets, and for aligning, with respect to offset edges of the sheets, a strip of tape to bind the adjacent edges together to form a booklet.

The apparatus comprises a frame, a pair of plates of unequal length pivoted along adjacent edges to the frame such that pivoting said plates with respect to said frame moves the same from a generally horizontal position to a vertical slightly spaced position whereby sheets may be inserted between said plates. One of said plates is provided with a locking means for locking the sheets to the plate after they are placed between the plates. One of the plates is then pivoted downward away from the other to bring the sheets from a generally vertical position to a generally horizontal position. A flexible sheet, disposed on one of the plates and having a free edge spaced from the locking means, provides means for rolling the sheets about the locking means and the opposite edges of the sheets. The flexible sheet and frame have cooperating holding means for holding the sheets in a rolled position with the free edges of the sheets positioned along a platen to support the shingled edges of the sheets for application of the tape. The angle formed between the platen and the plane of the plate supporting the sheets is less than 180° such that the flexible sheet rolls the sheets about an arc of greater than 180°, e.g., 225°. A slot is formed beneath the platen and adjacent the platen for receipt of and positioning of a cover to which an edge of the tape may be affixed to secure the bound sheets in a cover. Locating pin means are provided to position a tape strip on the platen.

DESCRIPTION OF THE DRAWINGS

The present invention will be described in greater detail hereinafter with reference to the accompanying drawings wherein.

DETAILED DESCRIPTION OF THE PRESENT INVENTION

The binding machine of the present invention provides means for receiving a plurality of sheets desired to be bound in a booklet, clamping means for clamping the sheets in an aligned position in the machine; means for bringing and holding the bound sheets in position on a platen wherein the edges of adjacent sheets are offset edgewise or shingled to expose an edge of each of said sheets to be bound; and a platen for supporting the edges during the application of a thin flexible tape to the edges of the sheets.

Figure 2:
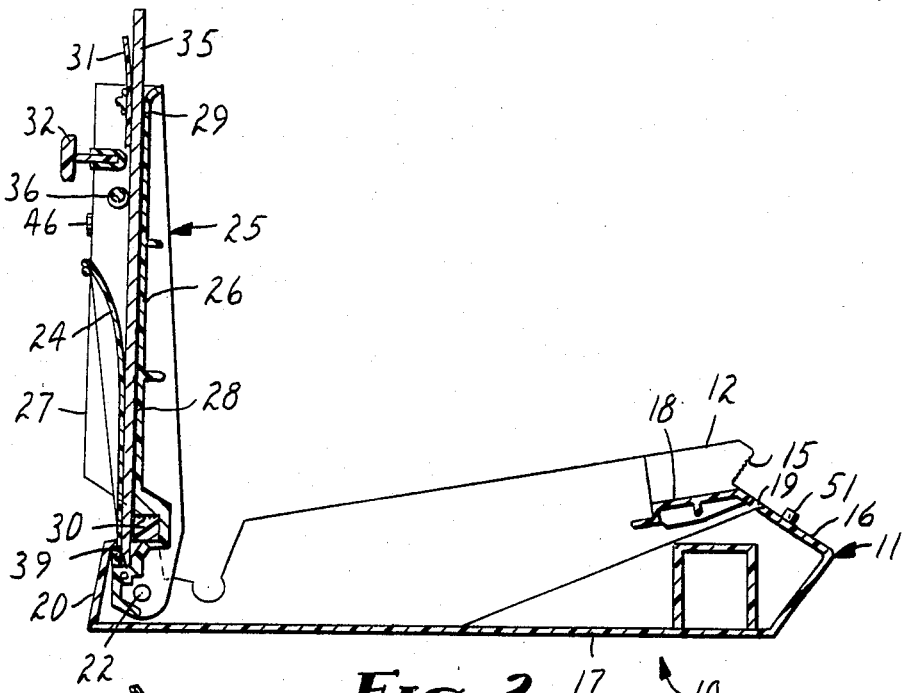
FIG. 2 is the longitudinal sectional view of the machine with the plates in sheet aligning position.
Figure 3:
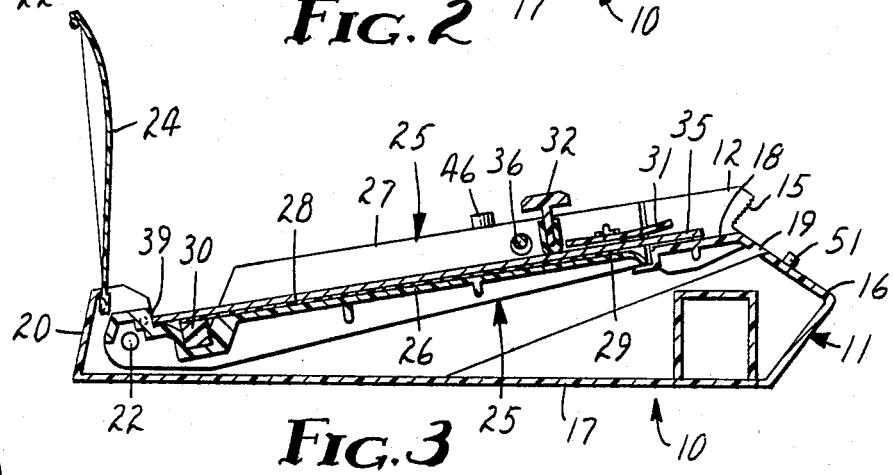
FIG. 3 is a longitudinal sectional view showing the sheets locked to the plate and the plate lowered to a position adjacent the platen.
Figure 4:
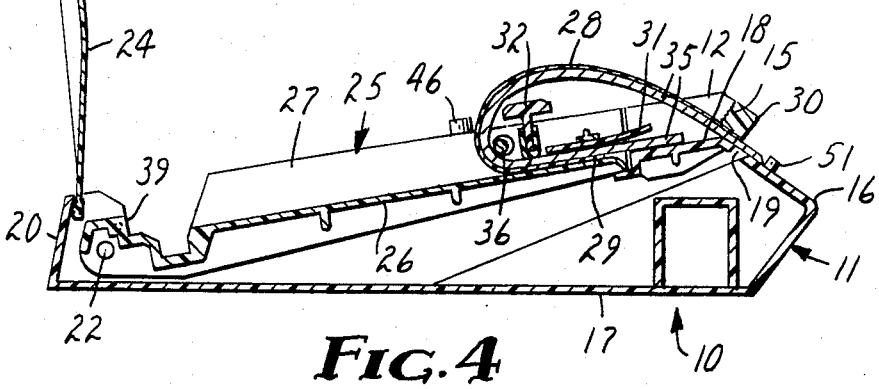
FIG. 4 is a longitudinal sectional view showing the sheets positioned in a shingled fashion with the shingled edges adjacent the platen.
Figure 6:
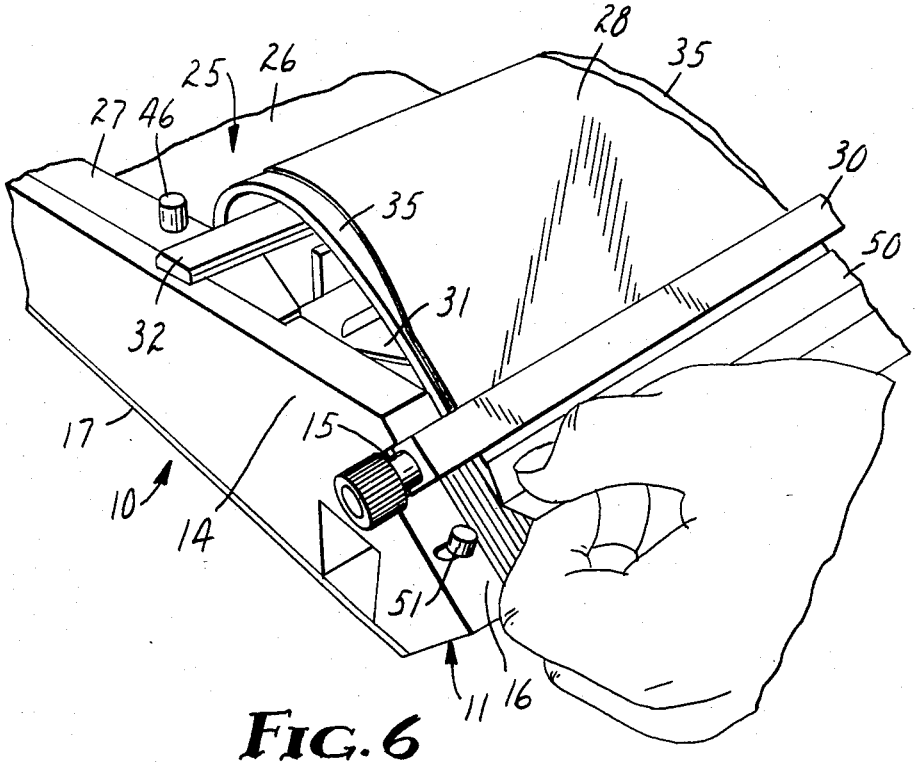
FIG. 6 is a perspective view illustrating the application of tape to the edges of the sheets on the platen.

The binding machine of the present invention, generally designated by the reference numeral 10, is lightweight and is adapted to be supported on a table during the binding of sheets. The machine 10 comprises a frame 11 having transversely spaced side walls 12 and 14. The side walls are each formed with a shoulder portion 15 adjacent the front edge thereof. The front edge of the side walls 12 and 14 are joined by a platen 16 disposed at an angle with respect to the horizontal and by bottom wall 17. Above the platen and between the side walls 12 and 14 is a support 18. The rear edges of the side walls are joined by vertical back wall 20. A top guide plate 24 is mounted for pivotal movement about an axis in the side walls adjacent the top edge of the back wall 20. Stub shafts 22 extend toward each other from each of the side walls 12 and 14 adjacent the back wall 20 and serve as an axis for pivotally supporting a sheet supporting and aligning frame generally designated 25, mounted about the shafts 22 for movement from a generally horizontal position with the frame 25 resting on the support 18 to the vertical position illustrated in FIG. 2. Plate 25 comprises a broad platform or plate 26 upon which is secured a flexible and preferably transparent sheet 28 of polymeric film. The sheet 28 is secured by a suitable adhesive to the plate 26 at the upper end as illustrated in FIG. 2 by an adhesive 29. The lower end of the sheet 28 is secured to a transverse bar 30 which is used to roll and hold the sheets to be bound in the curved position against the platen 16 as the bar 30 is moved from its position shown in FIG. 3 to a position where it engages the shoulders 15 as illustrated in FIG. 4.

When the frame 25 is pivoted to the generally horizontal position in engagement with support 18, the plate 26 is disposed at an angle of 135° to the plane of the platen 16. This permits the flexible sheet 28 to roll the sheets about an arc of 225° to cause the edges of the sheets to be offset by more than three times the thickness of each sheet. This exposes the edges of the sheets to assure contact with the adhesive of the binding tape.

The frame 25 also supports a guide plate 31 which is spaced from the plate 26 and a transverse locking bar 32 which moves perpendicular to the plate 26 to clamp the sheets illustrated at 35 against the plate 26. Positioned directly behind and parallel to the locking bar 32 is a guide bar and pivot axis 36 which serves to help position the sheets during binding and ties the locking mechanism together.

The frame 25 is also provided at the end adjacent the shaft 22 with a ledge 39 which aligns the edges of the sheets 35 when they are placed on the plate 26 between the plate 24 and the plate 26. In the vertical position the transverse bar 30 sits in a recess formed in edge wall 27 of the frame 25.

Figure 1:
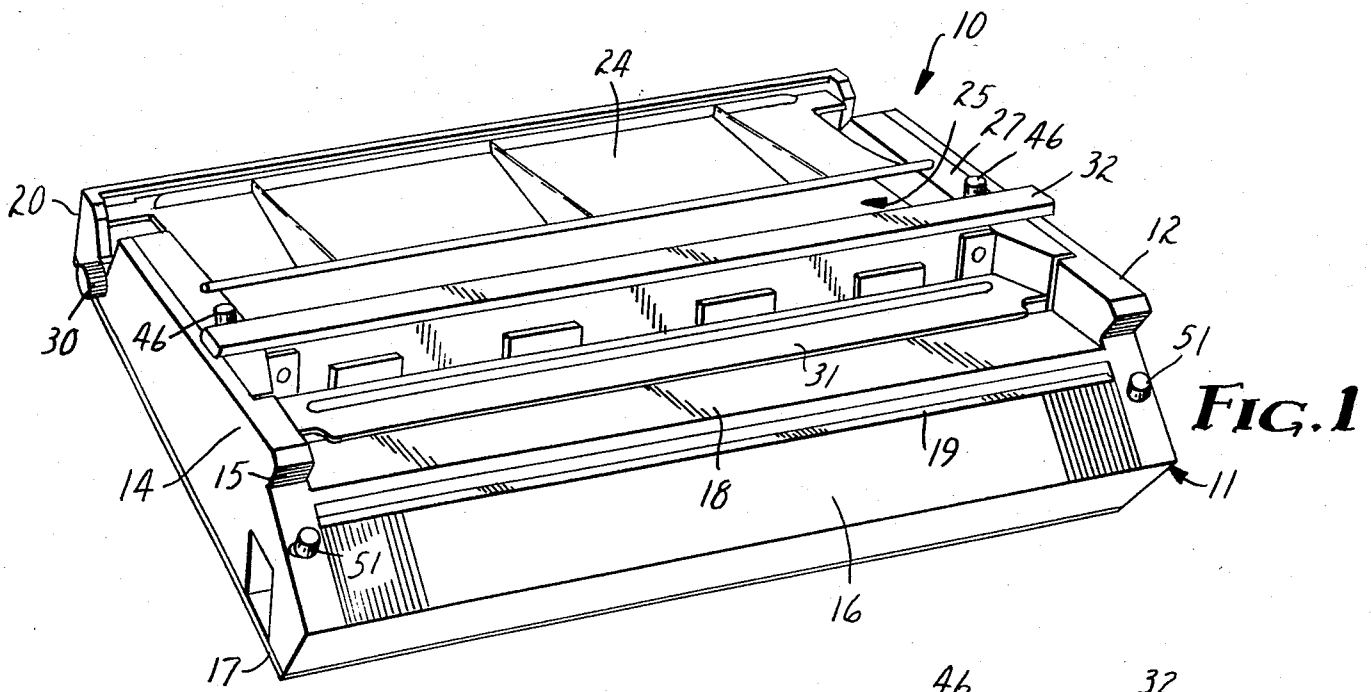
FIG. 1 is a perspective view of the binding machine of the present invention showing the front, top and left side of the machine.
Figure 5:
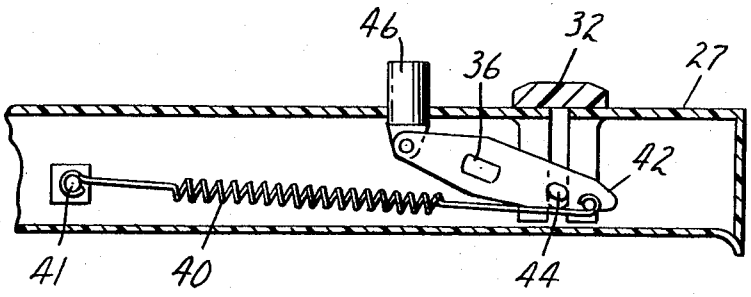
FIG. 5 is a detailed sectional view of the lock mechanism to lock the sheets in position.

With the sheets 35 aligned on the plate 26 and down against the ledge 39 the operator then presses the locking bar 32 to clamp one end of the sheets tightly against the plate 26 and the flexible sheet 28. The locking bar stays in the locked position under the biasing force of a locking unit in each side wall 27. Each locking unit comprises a string 40 disposed in the edge walls 27 of the aligning frame 25, see FIG. 5. Spring 40 is anchored on a pin 41 at one end and is fixed to a pivoted link 42 at the other end. The link 42 is connected by the pin 44 to the locking bar 32 and is fixed to one end of shaft 36 about which the link 42 is pivoted from the position shown in FIG. 5 to an over-center position by applying pressure to the release pins 46. Pins 46 are positioned to move vertically with respect to the edge walls 27 of the frame 25. When the pins are pushed, the locking bar is moved to the release position and when the locking bar is pushed, the spring moves to the over-center position to pull the locking bar against the sheets.

Figure 7:
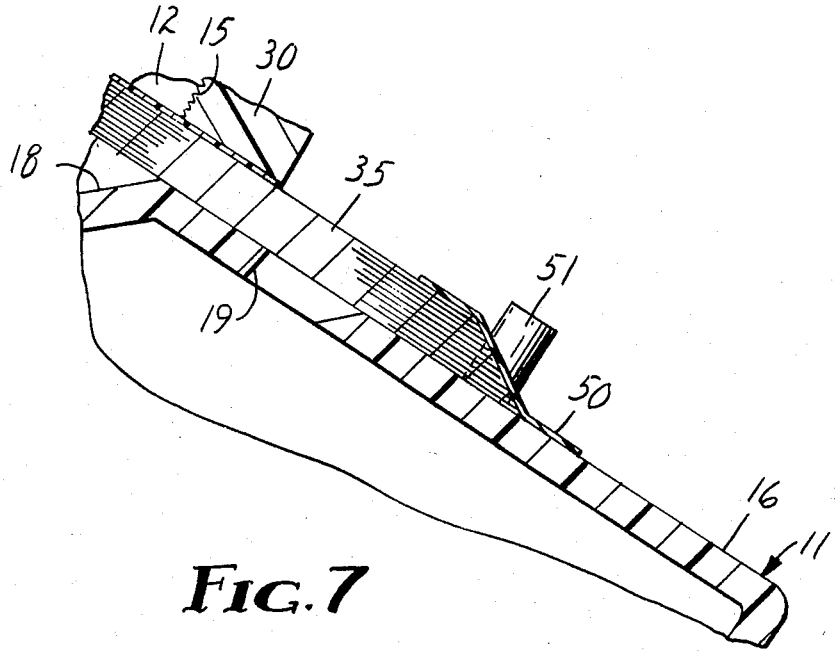
FIG. 7 is an enlarged detailed sectional view showing the tape on the edges of the sheets.

In binding sheets together the sheets 35 are placed between the guide plate 31 and the flexible sheet 28 as shown in FIG. 2 and they are lowered down through the slot until all of the sheets are aligned with an edge thereof touching the ledge 39. The locking bar is then moved from the position shown in FIG. 2 to the position shown in FIG. 3, clamping the sheets 35 against the flexible sheet 28 and the plate 26. The frame 25 is then pivoted about the axis 22 from its position in FIG. 2 to the position shown in FIG. 3 with the frame 25 adjacent the support 18. The bar 30 is then withdrawn from the recess and is lifted upward to bring the bar to a position beneath the shoulders 15 of the side walls 12 and 14 as illustrated in FIG. 4. This causes the sheets 35 to be placed in an arc about the rod 36 and the locking bar 32 and over the fixed edge of the sheets 35 to a position where the opposite edges of the sheets 35 become offset or shingled with respect to each other on the platen 16. In this position the sheets are held such that a piece of adhesive tape 50 can then be placed over the free edges of the sheets in the stack 35 as shown in FIG. 7. The tape 50 is a thin, very flexible strip of pressure sensitive adhesive tape having a thickness of adhesive which will bond tightly to the exposed surface portions of the sheets in the stack 35. The tape preferably has tabs which, to accurately position the tape across the ends of the sheets, are provided with openings which are positioned over locating pins 51. One of the locating pins 51 is preferably biased away from the other to initially tension the tape as it is placed over the pins and moved into contact with the shingled edges of the sheets on the platen 16.

If it were desired to place the sheets which are bound by the tape 50 in a cover, the cover would have been inserted into the slot 19 between the support 18 and the platen 16 such that the edge of the cover would be placed through the slot 19 and be positioned where the tape 50 is shown contacting the platen 16 in FIG. 7.

Having thus described the present invention with reference to the accompanying drawings, it is to be understood that changes may be made without departing from the scope and the spirit of the invention as described in the appended claims.

We claim:

1. A binding machine for binding a stack of sheets together comprising means defining a slot for receiving a plurality of sheets so they may be aligned edgewise, clamping means for clamping said sheets adjacent one edge in position in said slot, means for bringing and holding said aligned edges of said sheets over the opposite edges to a position for binding against a binding platen and for offsetting said sheets edgewise, and tape support means for positioning a length of pressure-sensitive tape along said platen and the offset edges of said sheets thereon for binding said sheets together.

2. A binding machine according to claim 1 wherein said means for bringing said sheets to the platen comprising a flexible sheet positioned along one side of said sheets for rolling said sheets through an arc of more than 180 degrees.

3. A binding machine according to claim 1 wherein said means for offsetting the aligned edges comprises a flexible sheet which is secured adjacent said clamping means and has a free end for engaging the sheets and rolling the sheets through an arc of greater than 180 degrees and bar means connected to said flexible sheet for holding said sheets on said platen.

4. A binding machine for binding a stack of sheets together comprising a frame, support means on said frame for receiving a plurality of sheets so they may be aligned edgewise, clamping means on said support means for clamping said sheets in aligned position on said support means, means for rolling and holding said aligned edges of said sheets over the clamping means to a position for offsetting the previously aligned edges of adjacent sheets edgewise, and platen means on said frame for supporting said offset edges whereby a length of pressure-sensitive tape may be positioned along said platen and the edges of said sheets thereon for binding said sheets together.

5. A binding machine according to claim 4 wherein said frame comprises a pair of side walls positioned transverse to and one at each end of said platen means, said support means comprises a second frame pivotally mounted on said side walls and having a plate movable between a position generally vertically disposed to a position angularly disposed to and adjacent said platen means whereby said means for rolling and holding said sheets places said sheets in an arc of greater than 180 degrees.

6. A binding machine according to claim 5 wherein said means for rolling and holding comprises a flexible sheet of material fixed to said plate and a bar secured to said sheet and engagable with said side walls adjacent said platen means for holding the sheets in place.

7. A binding machine according to claim 6 wherein at least one locating pin is positioned adjacent an end of said platen means for locating a strip of tape in relationship to said platen means.

* * * * *

UNITED STATES PATENT AND TRADEMARK OFFICE

CERTIFICATE OF CORRECTION

PATENT NO. : 4,518,296

DATED : May 21, 1985

INVENTOR(S) : Walter C. Pearson and Dorman N. Thompson, Jr.

It is certified that error appears in the above-identified patent and that said Letters Patent is hereby corrected as shown below:

Col. 5, lines 14 and 15, "comprising" should be -- comprises --.

Col. 6, line 10, after "platen" insert -- means --.

Signed and Sealed this

*Eleventh* Day of *February 1986*

[SEAL]

*Attest:*

DONALD J. QUIGG

*Attesting Officer*

*Commissioner of Patents and Trademarks*